US009657650B2

(12) United States Patent
Khan et al.

(10) Patent No.: US 9,657,650 B2
(45) Date of Patent: May 23, 2017

(54) ELECTRONIC THROTTLE BODY ASSEMBLY

(71) Applicants: Continental Automotive Systems, Inc., Auburn Hills, MI (US); Hella KGaA Hueck und Co, Lippstadt (DE)

(72) Inventors: Mohammed Rizwan Khan, Chatham (CA); Donald Taylor, Chatham (CA); John Norman Stockbridge, Waterford Township, MI (US); Stefan Köhler, Frankfurt (DE); Nathan Cowan, Chatham (CA); Joy Jacobs, Lippstadt (DE); Jennifer Betsistas, Lippstadt (DE); Dominik Ilse, Lippstadt (DE)

(73) Assignee: Continental Automotive Systems, Inc., Auburn Hills, MI (US)

( * ) Notice: Subject to any disclaimer, the term of this patent is extended or adjusted under 35 U.S.C. 154(b) by 12 days.

(21) Appl. No.: 14/716,291

(22) Filed: May 19, 2015

(65) Prior Publication Data

US 2015/0337768 A1 Nov. 26, 2015

Related U.S. Application Data

(60) Provisional application No. 62/001,348, filed on May 21, 2014.

(51) Int. Cl.
*F02D 9/10* (2006.01)
*F02D 11/10* (2006.01)

(52) U.S. Cl.
CPC ..... *F02D 9/1035* (2013.01); *F02D 9/1065* (2013.01); *F02D 11/106* (2013.01)

(58) Field of Classification Search
CPC ..... B01F 3/04; F02M 19/0207; F02D 9/08; F02D 9/10; F02D 9/1035; F02D 9/1065
(Continued)

(56) References Cited

U.S. PATENT DOCUMENTS 6,095,488 A 8/2000 Semeyn, Jr. et al.
6,543,417 B2 * 4/2003 Tanaka ..... F02D 11/10 123/361

(Continued)

FOREIGN PATENT DOCUMENTS

EP 2075441 A1 7/2009
EP 2497921 A1 9/2012
JP 2013185489 A 9/2013

OTHER PUBLICATIONS

Omnicoil: "Square Wire Spring Manufacturing", Aug. 30, 2012, XP055208070.

(Continued)

*Primary Examiner* — Robert A Hopkins

(57) ABSTRACT

A throttle body assembly includes a housing defining a throttle bore with a throttle plate in the bore and mounted on a shaft. An electric motor has a pinion gear. A gear assembly includes an intermediate gear and a sector gear and transfers rotational drive from the electric motor to the throttle plate. Biasing structure biases the sector gear and thus the shaft to cause the throttle plate to close the throttle bore defining a closed position thereof. When the motor is energized, rotation of the pinion gear causes rotation of the gear assembly, against the bias on the sector gear, thereby causing rotation of the shaft to move the throttle plate from the closed position to an open position. A position sensor assembly determines a position of the plate.

2 Claims, 4 Drawing Sheets

(58) Field of Classification Search
USPC ..... 261/38; 123/399, 361
See application file for complete search history.

(56) References Cited

U.S. PATENT DOCUMENTS

| | | | | |
|---|---|---|---|---|
| 6,918,374 | B1 | 7/2005 | Kurita et al. | |
| 8,448,627 | B2 * | 5/2013 | Kondo | F02D 9/1065 123/361 |
| 2008/0236541 | A1 | 10/2008 | Tsukiji et al. | |
| 2013/0160735 | A1 | 6/2013 | Cowan et al. | |
| 2013/0160738 | A1 | 6/2013 | Cowan | |
| 2013/0284147 | A1 | 10/2013 | Nicholas | |
| 2014/0144407 | A1 | 5/2014 | Khan et al. | |

OTHER PUBLICATIONS

"Powertrain Products" Sep. 30, 2013, XP055208106. pp. 1-2, 61-64 and 99.

International Search Report for PCT/US2015/031585 mailed on Aug. 27, 2015.

* cited by examiner

ELECTRONIC THROTTLE BODY ASSEMBLY

CROSS-REFERENCE TO RELATED APPLICATIONS

This application claims the benefit of U.S. Provisional Application No. 62/001,348 filed May 21, 2014. The disclosure of the above application is incorporated herein by reference.

FIELD

The invention relates generally to an electronic throttle body assembly for controlling air flow into the engine of a vehicle.

BACKGROUND

Throttle body assemblies are generally known, and are used for controlling the amount of air flow into the engine during vehicle operation. Due to the advancement of technology implemented in modern vehicles, and the increased number of options and features available, there have also been greater restrictions placed on the packaging configuration of throttle body assemblies, as well as greater limitations on the location and placement of the throttle body assembly. Requirements are also such that throttle body assemblies be adaptable for gasoline and diesel applications.

Furthermore, with the different orientations of an engine possible within an engine compartment, there is also the requirement for throttle body assemblies to have right-hand and left-hand configurations.

Accordingly, there exists a need for a throttle body or valve assembly which accommodates of the above mentioned requirements.

SUMMARY

The present invention is a throttle body assembly which accommodates various packaging configurations, and is adaptable for both gasoline and diesel applications.

In accordance with an embodiment, a throttle body assembly for controlling aspiration to an engine includes a housing defining a throttle bore. A throttle plate is disposed in the bore and is mounted on a shaft. A gear assembly is constructed and arranged to transfer rotational drive from an electric motor to the throttle plate. Biasing structure is constructed and arranged to bias the gear assembly and thus the shaft to cause the throttle plate to close the throttle bore defining a closed position thereof. A throttle position sensor assembly is constructed and arranged to monitor a position of a sensor element and thus the throttle plate. When the motor is energized, rotation of the gear assembly, against the bias thereon, thereby causing rotation of the shaft to move the throttle plate from the closed position to an open position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
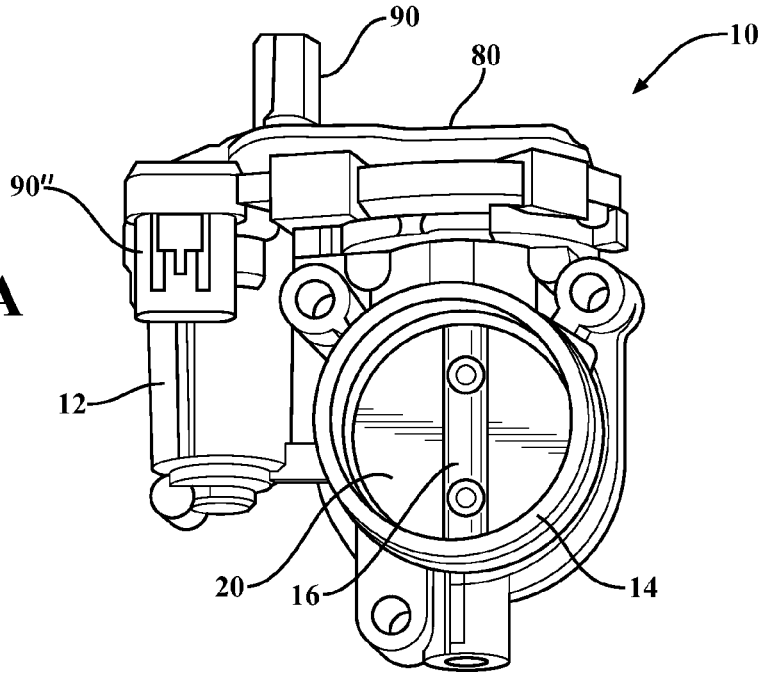
FIG. 1A is a top view of a throttle body assembly, according to an embodiment of the present invention.

A throttle body assembly according to an embodiment is shown, generally indicated at 10, in FIG. 1A for use in controlling aspiration to an engine. The assembly 10 includes a housing 12 with an integral central bore 14, through which air passes during operation of the assembly 10. A rotatable shaft 16 is disposed in the central bore 14. The shaft 16 includes a valve member 20 disposed in a slot formed as part of the shaft 16. In the embodiment, the valve member 20 is in the form of an annular throttle plate.

The shaft 16 is partially disposed in an aperture formed in the housing 12 and disposed transverse with respect to bore 14. At least one needle bearing is disposed in aperture that supports the shaft 16 and allows for the shaft 16 to rotate relative to the housing 12. An actuator, preferably in the form of an electric motor 38, is disposed in a cavity formed as part of the housing 12. A pinion gear 42 is part of a gear assembly, and is attached to the motor 38. The gear assembly is located in a gear box housing 114.

Biasing structure 62 is also located in the gearbox housing 114. In the embodiment, the biasing structure 62 is a return spring assembly 62. The biasing structure 62 biases the shaft 16 to cause the throttle plate 20 to close the throttle bore 14.

Figure 3:
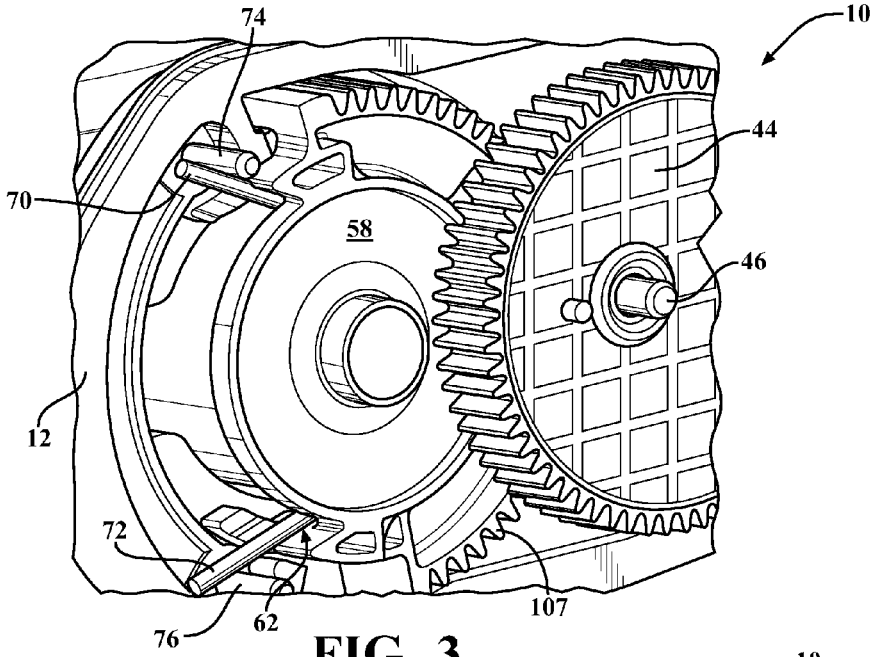
FIG. 3 is an enlarged perspective view of an intermediate gear associated with a sector gear of the throttle body assembly of FIG. 6, with the cover removed.

A pinion gear 42 is attached to the rotatable shaft 43 of the motor 38. The pinion gear 42 is part of a gear assembly and is in meshing relation with teeth of a first gear 45 of a plastic intermediate gear, generally indicated at 44 in FIGS. 3-5. The intermediate gear 44 is mounted on an intermediate shaft 46, and the intermediate shaft 46 partially extends into an aperture formed in housing 12. A second or middle gear 54 is formed integrally and concentrically with the intermediate gear 44. The middle gear 54 has a smaller diameter than the first gear 45 and is spaced there-from. With reference to FIG. 6, when the middle gear 54 and first gear 45 are mounted on the shaft 46, the middle gear 54 is disposed for rotation in a recess 56 in housing 12 so that the teeth of the middle gear 54 are in meshing relation with teeth 107 of a preferably plastic sector gear 58 that is fixed to the shaft 16. The intermediate gear 44 and the sector gear 58 define a gear assembly of the throttle body assembly 10.

A first end 70 the return spring 62 is in contact with a first pin 74 functioning as a first spring stop, and a second end 72 of the return spring 62 is in contact with a second pin 76 functioning as a second spring stop. Each of the pins 74, 76 are partially disposed in corresponding apertures formed in the housing 12. The spring 62 biases the sector gear 58 and thus the shaft 16 to cause the throttle plate 20 to close the throttle bore 14. In an alternate embodiment shown in FIG. 6, stops 75 and 77 are surfaces of the housing 12 and thus are formed integral with the housing 12, replacing the pins 74, 76 of FIG. 5.

A cover 80 is connected to the housing 12. More specifically, the gear box housing 114, and partially surrounds the gear assembly. The cover 80 is connected to the housing 12 using a plurality of clips 86. Once the cover 80 is placed on the housing 12, the clips 86 connect the cover 80 to the housing 12. Once the cover 80 is attached to the housing 12 the terminals for the motor 38 can be accessed or viewed through an opening in the cover 80. Once it is determined that the terminals of the motor 38 are in contact with the terminals of a lead frame, a secondary cover 88 is attached to the cover 80 to close the opening. The lead frame is part of the cover 80, and defines motor leads which place the connector 90 in electrical communication with a sensor, the function of which will be explained below.

The cover 80 also includes a connector 90 which is in electrical communication with the motor 38, such that the connector 90 is able to be connected to a source of power. The lead frame is in electrical communication with a printed circuit board (PCB) 94, and the electric motor 38. The lead frame is also in electrical communication with the connector 90. For reverse motor direction, the polarity of the motor 38 can be reversed.

The leads of the leadframe include a first set of terminals which are in electrical communication with the printed circuit board (PCB) 94, and a second set of terminals which are connected to and in electrical communication with the electric motor 38.

Figure 1B:
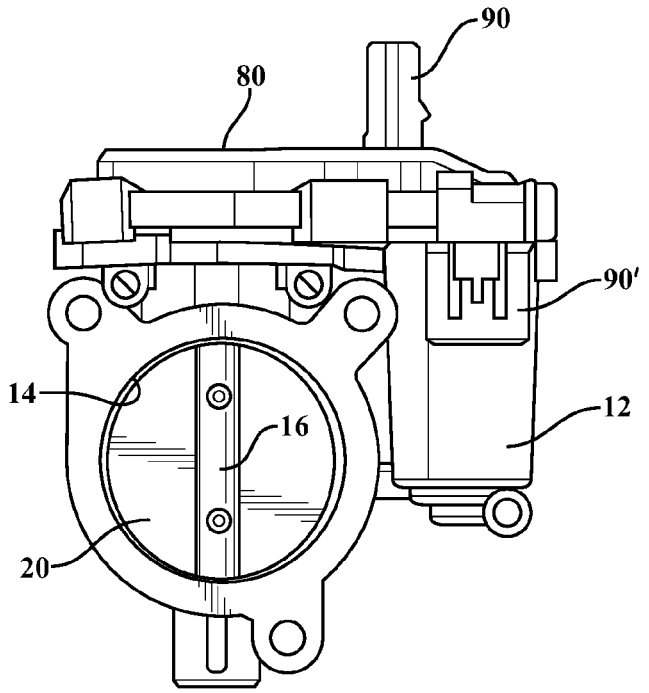
FIG. 1B is a bottom view of a throttle body assembly of FIG. 1A.
Figure 2:
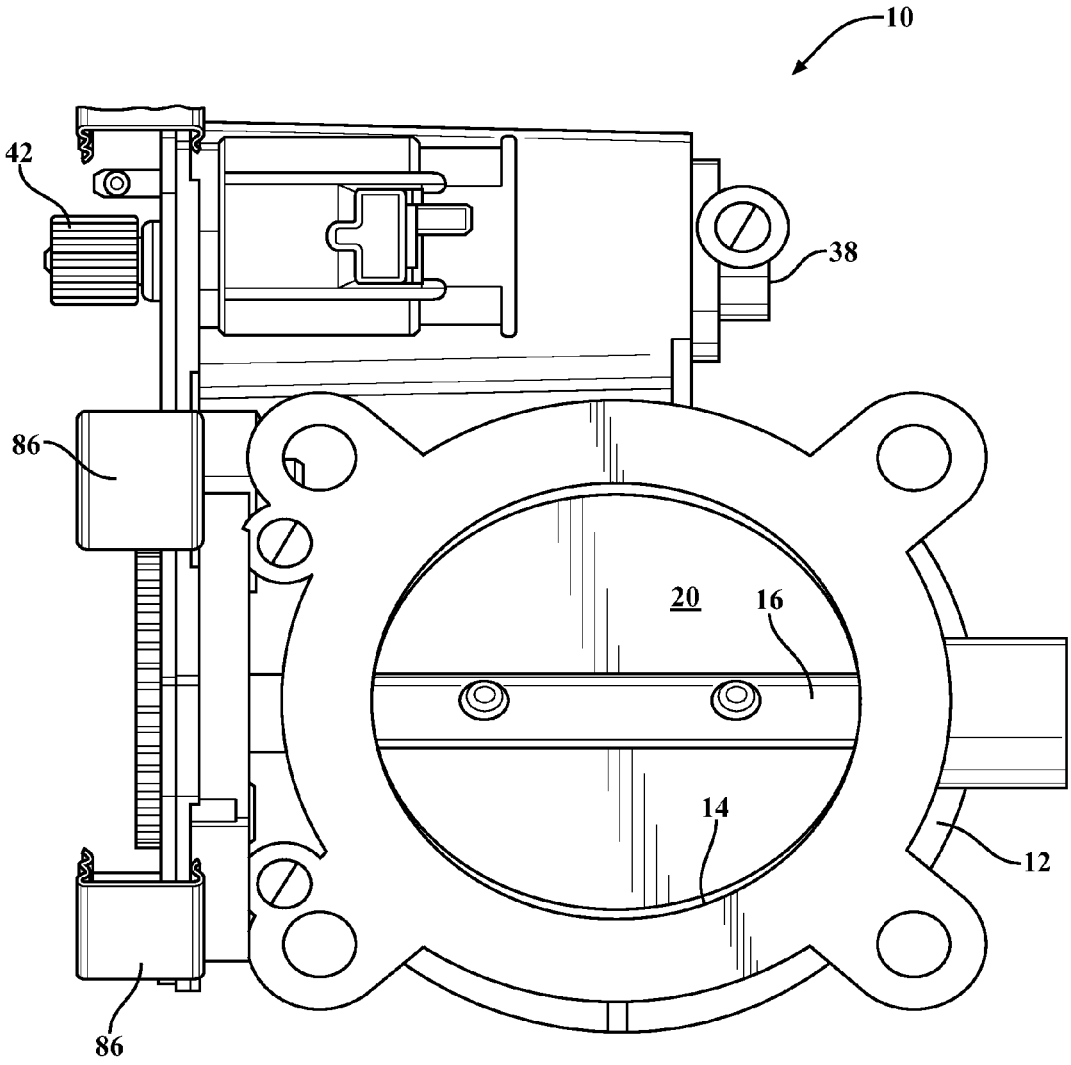
FIG. 2 is a bottom view of a throttle body assembly with the cover removed, according to another embodiment.

FIGS. 1A and 1B show another embodiment of the cover 80 where a single cover includes all three connectors 90, 90' and 90". Thus, depending on the orientation required, the terminals are provided in the appropriate connector and the leads are configured based on the selected connector location. This ensures a common seal profile, a common cover 80 and common sealing area on the housing 12, which reduces number of components required and thus saves cost. Also, the same cover 80 can be used for different types of sensors 94.

The throttle body assembly 10 comprises an inductive rotary position sensor assembly that includes a sensor element (not shown) that is disposed with respect to the inductive rotary position sensor 94 so as to be in an electrically inductive relationship therewith. In this configuration, the position sensor 94 detects movement and position of the sensor element, which is compared to reference data to determine the position of the throttle plate 20.

Figure 4:
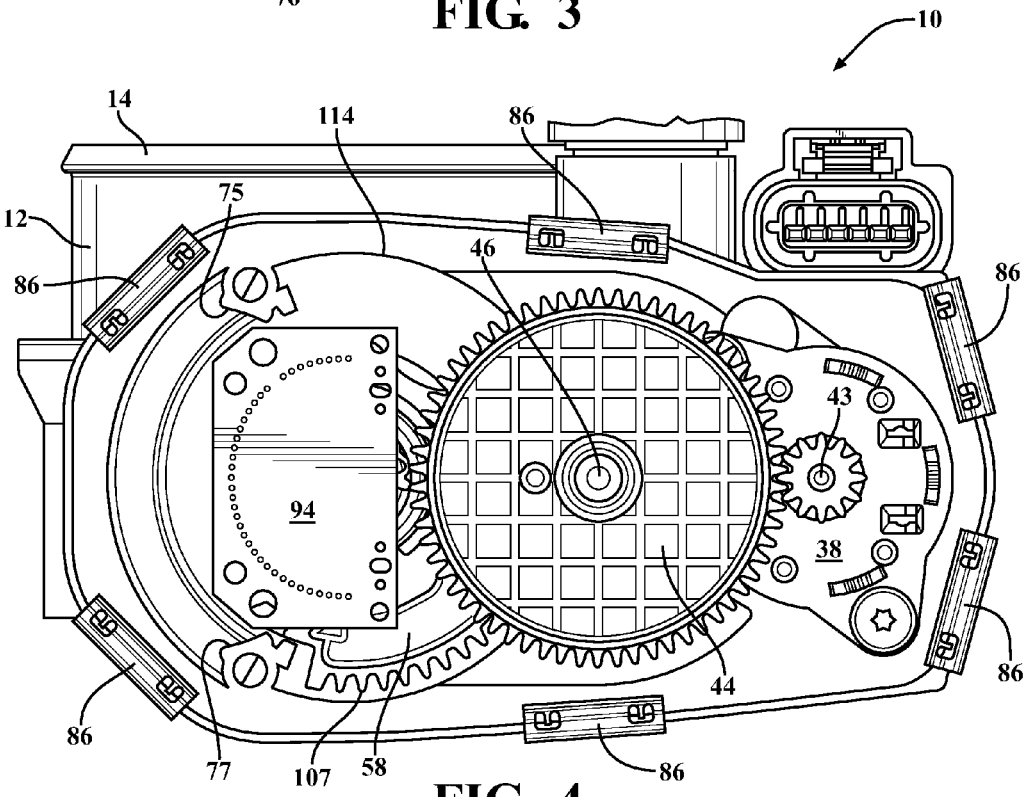
FIG. 4 is a side view of the throttle body assembly of FIG. 1A, with the cover removed, showing the return spring and cooperating stop pins.
Figure 5:
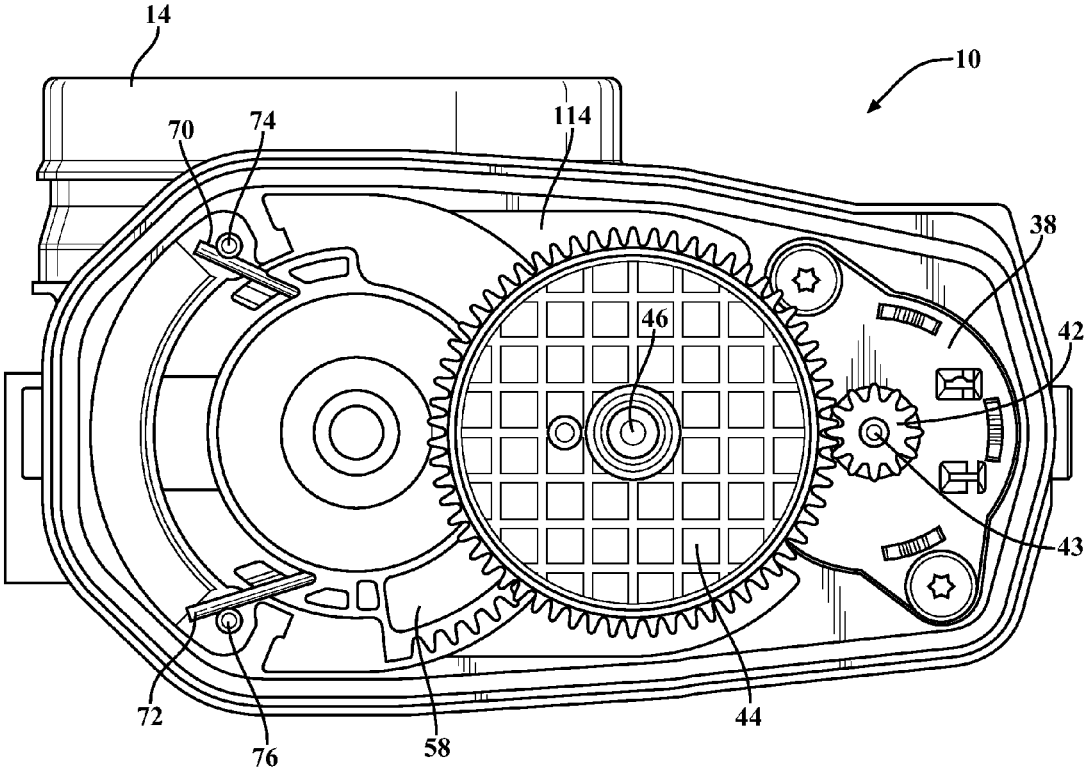
FIG. 5 is a side view of a throttle body assembly, with the cover and the sensor removed, showing stops integral with the housing that engage the return spring in accordance with another embodiment.

Referring to FIG. 6, the sensor element, preferably of aluminum, is attached to the sector gear 58. The sector gear 58 includes an insert 96 that is welded or otherwise coupled to the end of the shaft 16. Thus, as the throttle plate 14 is moved between an open position and closed position, the sensor element moves with the sector gear 58. Accordingly, movement and position of the sensor element is directly related to movement and position of the throttle plate 20. Referring to FIGS. 4 and 6, the position sensor 94 is disposed in an inductive relationship to the sensor element. In the configuration shown, the position sensor 94 is mounted to inside of the cover 80 of the throttle body assembly 10 using suitable attachment means. In one embodiment, the position sensor 94 is sized and contoured to fit beside the intermediate gear 44 (the position sensor 94 is adjacent the intermediate gear 44), which provides another advantage for packaging. In the embodiment shown in FIG. 4, the position sensor 94 has a flat surface adjacent the intermediate gear 44, but it is within the scope of the invention that the position sensor 94 may have other shapes to curve around the intermediate gear 44, or away from the intermediate gear 44. Furthermore, the sensor 94 may be is secured into the gearbox cover 80 by heat stakes, glue, clip features, along with press-fit terminals with or without solder, or non press-fit terminals with or without solder. The position sensor 94 comprises a PCB sensor board so that as the sensor element moves, different inductive readings are observed across the sensor board 94, which are transferred a sensor processor, which transmits signals to a monitor or control unit of the throttle body assembly 10, or engine, through connector 90.

In operation, the spring 62 biases the sector gear 58, and therefore the shaft 16 and throttle plate 20 towards a closed position, such that the central bore 14 is substantially closed, or blocked completely, depending upon how the assembly 10 is configured. When current is applied to the motor 38, the pinion gear 42 is rotated, which causes the rotation of the first gear 45 of the intermediate gear 44, the second or middle gear 54 of the intermediate gear 44, and the sector gear 58. To rotate the sector gear 58, the bias applied to the sector gear 58 by the return spring 62 is overcome. The amount of rotation of the sector gear 58 is in proportion to the amount of current applied to the motor 38, which must overcome the force applied to the sector gear 58 by the return spring 62. Since the sector gear 58 is coupled to the shaft 16 by the insert 96, rotation of the sector gear 58 rotates the shaft 16 to open the plate 20. As noted above, the sensor element and the position sensor 94 detect the position of the sector gear 58 and thus the plate 20 during the operation of the throttle body assembly 10.

As the sector gear 58 is rotated, the shaft 16 is rotated as well, rotating the plate 20, and allowing increased levels of air flow through the central bore 14. The amount of rotation of the sector gear 58 is detected by the sensor 94, such that the valve plate 20 may be placed in a desired position.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An valve assembly comprising:

a housing defining a throttle bore, a throttle plate disposed in the bore and mounted on a shaft, an electric motor having a pinion gear, a gear assembly comprising an intermediate gear and a sector gear, the gear assembly being constructed and arranged to transfer rotational drive from the electric motor to the throttle plate, the intermediate gear being mounted for rotation and having a first gear engaging the pinion gear so that rotation of the pinion gear rotates the intermediate gear, the intermediate having a second gear, the sector gear being coupled to the shaft and having a sector of teeth, the second gear engaging teeth of the sector gear, biasing structure constructed and arranged to bias the sector gear and thus the shaft to cause the throttle plate to close the throttle bore defining a closed position thereof, and a throttle position sensor assembly comprising a sensor element associated with the shaft and an inductive rotary position sensor placed in inductive relationship with the sensor element, the throttle position sensor assembly being constructed and arranged to monitor a position of the sensor element and thus the throttle plate, the position sensor being sized and contoured to fit beside the intermediate gear, wherein, when the motor is energized, rotation of the pinion gear causes rotation of the first gear, with the second gear causing rotation of the sector gear, against the bias thereon, thereby causing rotation of the shaft to move the throttle plate from the closed position to an open position.

2. The assembly of claim 1, wherein the position sensor is secured into the gearbox cover by one selected from the group consisting of heat stakes, glue, clip features, press-fit terminals with solder, press-fit terminals without solder, non press-fit terminals with solder, non press-fit terminals without solder, and combinations thereof.

* * * * *